United States Patent [19]

Dettke et al.

[11] 4,140,590

[45] Feb. 20, 1979

[54] PROCESS FOR GALVANIZING LIMITED SURFACE AREAS

[75] Inventors: Manfred Dettke; Wolfgang Weishaupt, both of Berlin, Fed. Rep. of Germany

[73] Assignee: Schering AG, Berlin, Fed. Rep. of Germany

[21] Appl. No.: 875,293

[22] Filed: Feb. 6, 1978

[30] Foreign Application Priority Data

Feb. 4, 1977 [DE] Fed. Rep. of Germany ..... 2705158

[51] Int. Cl.[2] ..... C25D 5/02; C25D 5/08

[52] U.S. Cl. ..... 204/15; 204/224 R

[58] Field of Search ..... 204/15, 224 R, 129.6

[56] References Cited

U.S. PATENT DOCUMENTS

| | | | |
|---|---|---|---|
| 1,285,875 | 11/1918 | Woodbury | 204/224 R |
| 2,937,124 | 5/1960 | Vaughan | 204/129.6 |
| 2,958,636 | 11/1960 | Hershinger | 204/129.6 |
| 3,071,521 | 1/1963 | Ehrhart | 204/224 R |
| 3,294,664 | 12/1966 | Franklin | 204/224 R |
| 3,546,088 | 12/1970 | Barkman et al. | 204/224 R |

*Primary Examiner*—T. M. Tufariello

*Attorney, Agent, or Firm*—Michael J. Striker

[57] ABSTRACT

Limited surfaces areas are galvanized by depositing a metal or metal alloy from an electrolytic solution which is applied in a jet stream so as to make contact with said surface at a predetermined spot and follow the outline of the surface up to a second predetermined spot where it is detached from the surface by suction action.

7 Claims, 4 Drawing Figures

PROCESS FOR GALVANIZING LIMITED SURFACE AREAS

BACKGROUND OF THE INVENTION

The invention relates to a process for galvanizing limited areas of conductive surfaces or surfaces which have been made conductive by depositing a metal or metal alloy from an electrolytic solution.

Processes of this type have already become known. They usually are based on two fundamental principles. The parts to be galvanized are either contacted with the electrolyte only at the desired spots while dipping into an electrolytic bath. This contact can for instance be obtained by use of rollers (West German Pat. No. 186,654), wheels (West German Pat. No. 2,324,834) or open hollow spaces (West German Pat. No. 1,807,481). Another process makes use of the conventional baths but modifies the metal ion supply and the electrical field distribution at the surface to be treated by interposition of for instance shields (West German Pat. No. 2,263,642), cover devices (West German Pat. No. 2,362,489), electrically isolated rims moving on rollers (West German Pat. No. 2,009,118), baskets (West German Pat. No. 2,230,8911), or lacquer coatings (West German Pat. No. 2,253,196).

These prior processes have the shortcoming that they permit only deposits of more or less uniform coating thicknesses. However, in order to improve the functional properties of technical surfaces such as in plug or switch contacts it is desirable to have a thick coating only in the immediate contact area while for the remaining surface a thinner coating is sufficient as corrosion protection. The transition between the different coating thicknesses in this case should be even and in case of plug and switch contacts these should for instance be a lenticular distribution of thicknesses in the contact area.

Further shortcomings of the prior art are that either there is only an unsatisfactory metal ion supply which results in a deficient metal coating, or they are rather expensive and time- and material-consuming since the necessary covering must first be installed and then again be removed and masks must be renewed after certain periods of time because of wear and tear.

It is therefore an object of the present invention to provide for a process for galvanizing limited areas of conductive surfaces or surfaces that have been made conductive by means of deposit of metal or metal alloys from electrolytic solutions in which the shortcomings of the prior art processes are avoided and in which in particular a distribution of coating thicknesses is obtained so as to comply with the function of the article.

SUMMARY OF THE INVENTION

This object is accomplished by causing a jet stream of the electrolyte solution to make contact with the surface at a predetermined place, then to follow the outline of the surface up to a second predetermined place where the stream is detached from the surface by suction action.

Preferred embodiments of the invention have the following features:

(1) The electrolyte solution flows out of a nozzle onto the surface and is removed by suction from one or more receiver nozzles.

(2) The nozzle or a part of the nozzle or the otherwise constructed electrolyte inlet is formed as the anode while the surface to be galvanized is the cathode of the design.

(3) The receiver nozzle or a part thereof or the otherwise constructed outlet for the electrolytic stream may be designed as an auxiliary anode.

(4) The receiver nozzles abut on the surface to be galvanized.

(5) The jet stream of the electrolytic solution which follows the outline of the surface is again detached from the surface at a predetermined place by means of an air current produced through the receiver nozzle, and (6) in case of closely contiguous surfaces common outlet nozzles and/or receiver nozzles are used for several surfaces causing different jet streams, if desired, to merge with each other. The term "conductive surface" in this case is implied to refer to surfaces which preferably are electron conductive but may also be ion conductive, for instance metals, metal oxides and/or metal sulfides.

Surfaces which have been rendered conductive on the other hand are understood to mean surfaces which by thin metallic, metal oxide and/or metal sulfide coatings have been made conductive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILS OF THE INVENTION AND PREFERRED EMBODIMENTS

Figure 2:
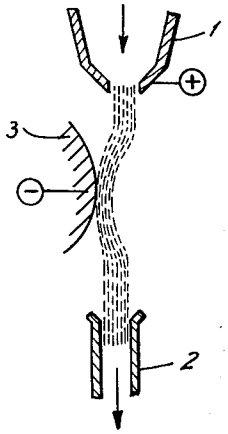
FIG. 2 shows the tangential contact of the surface of the jet stream with the surface to be galvanized in which case the workpiece is the cathode and the outlet nozzle the anode.

As in particular appears from FIG. 2 the invention makes use of the so-called Coanda effect which causes a jet stream for instance of an electrolytic solution to follow the contour of a wall surface even though the surface may have a curved outline provided the jet stream is discharged in the neighborhood of the surface. If, as preferable, the workpiece forms the cathode and the outlet nozzle is formed as the anode, the receiving nozzle may constitute an auxiliary anode in order to improve the current line distribution.

Figure 1:
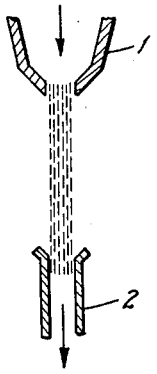
FIG. 1 of the drawing shows the general design of a jet stream of a conductive solution passing from an outlet nozzle to a receiving nozzle.

With reference to the figures it will be seen that 1 is the outlet nozzle, 2 is the receiving nozzle, and as appears particularly from FIG. 1, the electrolytic stream is downwards directed. When the stream approaches the surface tangentially the stream will follow the outline of the surface of the workpiece 3.

The detachment of the electrolytic stream from the surface depends on the shape of the workpiece and the disposition of the receiving and outlet nozzles. For instance the detachment may be effected by means of a receiving nozzle which abuts on the surface, or by means of an air current produced through the receiving nozzle. The process of the invention is particularly suited for galvanizing limited areas of closely proximate surfaces. In this case several surfaces may be associated with common outlet and/or receiving nozzles and the individual jet streams may be caused to merge into each other.

Figure 3:
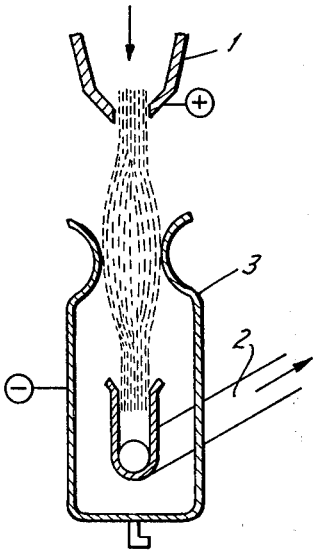
FIG. 3 shows the use of the invention for treating two oppositely disposed contact surfaces of a forked contact spring.
Figure 4:
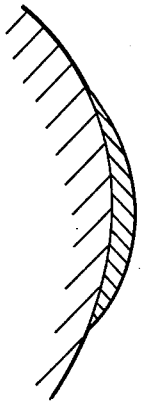
FIG. 4 shows, in an enlarged cross section, an electrical contact made by the process of the invention on a convex surface.

With particular reference to FIG. 3 it will be seen that the proceeds of the invention can be used for simultaneous galvanizing of two oppositely disposed contact surfaces of a forked contact spring. The electrolytic jet stream in this case makes contact with the contact spring at the same places which later are subject to stress due to movement of the contact pin. This applies not only for the static contact area, but also for the surfaces which are particularly subject to friction during the plugging-in or separation of the contact member.

The evaluation of measurements of the thicknesses of the coating in contact springs as just described has shown that the maximum coating thickness was formed at those places which were subject to the maximum electrical and mchanical stress and the transition from these surfaces to the surface which had not been galvanized was in uniform manner, that is, there was an even decrease of the maximum thickness to the neighboring surfaces.

The distribution of coating thicknesses on the treated surface in the process of the invention is conditional upon the current profile of the electrolyte at the surface. This current profile depends mainly from the shape of the nozzles and can be modified by employing nozzles with different cross-sectional diameter. The electrolyte jet can also be subject to additional shaping if the surrounding area is also subject to air suction through the receiving nozzle.

The flow profile can further be modified by causing the nozzles and/or the surfaces to be galvanized to move towards each other.

The distribution of thicknesses of the coating in addition can also be modified by changing the electrolyte supply to the surface, for instance by means of changes in the flow speed of the electrolyte stream and/or by changing of the electrical current density.

As for the type of electrolyte solutions they may be those conventionally used in this kind of process.

It is also possible if desired to change the sequence of coatings by the use of electrolyte solutions of different compositions and this change may be effected in continuous or discontinuous alternation.

In addition, it is possible that several surfaces, particularly surfaces present inone and the same workpiece may be subject to different treatments in cases where more than one jet stream according to the invention are employed.

The process of the invention is of particular use where a saving in valuable metals should be accomplished or where because of the intended function of the coating a special shape thereof is desired. A process of the invention thus may have use in electrotechnical applications to form selective functionally proper coatings of noble metals for contact springs in the area of the contacts proper. A particular advantage of the process is that it can be used also with those articles where up to now a selectively different coating was not possible or was possible only to an unsatisfactory degree.

The metal ion supply to the surface to be galvanized in the process of the invention is extremely good and is surprisingly the same or even larger than in case of electrolytes which are applied in electrolytic baths. Since the process is carried out without requiring any cover devices it saves material, cost and time.

A further advantage of the process of the invention is that it is possible to use a cathode current density which is higher by factors of 10 to 100 than in case of conventional galvanization installations so that it is possible to obtain an extraordinary increase of the deposit speed.

It is possible with the process of the invention to treat specific areas of the surface in a technically extremely simple manner and at a level of quality which heretofore could not be reached and that it is in particular possible to provide such surfaces with a functionally perfect metal coating.

The following examples will further illustrate the invention.

EXAMPLE 1

Gold plating for contacts

The base material of contacts is in almost all cases an alloy of which the principal component is copper. In order to obtain a permanently serviceable contact a sufficiently strong nickel diffusion barrier must be built up in view of the well-known copper-gold diffusion mechanism.

The process of the invention permits the deposit of both coatings and the preliminary gold plating without the requirement of any access way.

The composition of an electrolyte and the conditions of application are for instance as follows:

| | |
|---|---|
| nickelsulfate $NiSO_4 . 6 H_2O$ | 300 g/liter |
| nickelchloride $NiCl_2 . 6 H_2O$ | 45 g/liter |
| boric acid $H_3BO_3$ | 40 g/liter |
| sodiumlaurylsulfoacetate | 2 g/liter |
| pH | 4.0 |
| temperature | 65° C |
| cathode current density | 20 to 50 A/dm$^2$ |
| exposure time for 1 $\mu$ is | 10 seconds |

The deposited nickel coatings are matt silky. Their structure is colunn-like. The Vickers hardness of the coatings is 200 + 20 kp/mm$^2$.

The contacts are subjected to gold plating after a preceding rinsing which causes excellent adhesion properties.

The composition and the conditions of application of a preliminary gold plating by means of an electrolyte are for instance as follows:

| | | |
|---|---|---|
| (a) | gold as $KAu(CN)_2$ | 0.5 g/liter |
| | sodium citrate | 60 g/liter |
| | tetraethylenepentamine | 10 g/liter |
| | cobalt as complex with dipotassium salt of ethylenediaminetetra-acetic acid | 1 g/liter |
| | pH | 3.8 |
| | temperature | 20 to 25° C |
| | current density | 5 to 10 A/dm$^2$ |
| | exposure time | 10 seconds |
| (b) | gold as $KAu(CN)_2$ | 8.0 g/liter |
| | ammoniumsulfate $(NH_4)_2SO_4$ | 30.0 g/liter |
| | boric acid $H_3BO_3$ | 60.0 g/liter |
| | ethyleneglycol $HO—CH_2—CH_2—OH$ | 60.0 g/liter |
| | cadmiumsulfate $CdSO_4 . 8/3 H_2O$ | 3.5 g/liter |
| | ethylenediaminetetra-acetic acid dipotassium salt | 4.0 g/liter |
| | formaldehyde $CH_2O$ | 10.0 g/liter |
| | hydrazine sulfate $N_2H_4 . H_2SO_4$ | 30.0 g/liter |
| | sodium arsenite $Na_3AsO_3$ | 6.5 g/liter |
| | pH | 8.0 |

-continued

| | |
|---|---|
| temperature | 60° C |
| current density | 30 to 60 A/dm$^2$ |
| exposure time for 1 μ | 2 seconds |

The coatings have about 23.8 carat. The coatings deposited from the electrolyte have a high gloss and are tarnish resistant. The distribution of the coating thicknesses on the contact surface shows a steep decrease in upwards direction. At the lateral borders of the contact which do not serve as contact surfaces there is formed one-fifth of the coating thickness when nozzles of 1.0 mm diameter are used.

| | | |
|---|---|---|
| (a) | gold as KAu (CN)$_2$ | 12 g/liter |
| | potassium dihydrogencitrate | 150 g/liter |
| | cobalt as chelate complex | 1.5 g/liter |
| | wetting agent | 2.0 g/liter |
| | pH | 4.0 |
| | temperature | 35° C |
| | current density | 20 to 100 A/dm$^2$ |
| | exposure time for 1 μ is | 1 to 10 seconds |

The deposits in this case have excellent electrical properties and are distinguished by a high abrasion resistance because of the incorporation of 0.3 to 0.5% Co. The distribution of coating thicknesses is as good as in the preceding example (b).

EXAMPLE 2

Silver plating of contacts

Instead of the gold plating, a silver plating of the contacts can be carried out with the following electrolytes and conditions:

| | | |
|---|---|---|
| (a) | silver as silverthiosulfate $Na_3Ag(S_2O_3)_2$ | 25 g/liter |
| | sodiumthiosulfate $Na_2S_2S_3 \cdot 5\ H_2O$ | 120 g/liter |
| | borax $Na_2B_4O_7 10\ H_2O$ | 10 g/liter |
| | polyethyleneimine MG 500 - 1000 | 0.2 g/liter |
| | sodiumsulfite $Na_2SO_3$ | 20 g/liter |
| | pH | 8.8 |
| | temperature | 28° C |
| | current density | 30 to 40 A/dm$^2$ |
| | deposit formation 1 μ in 1.5 to 2 seconds | |
| (b) | silver as potassiumsilvercyanide KAg(CN)$_2$ | 30 g/liter |
| | potassiumcyanide KCN | 120 g/liter |
| | antimonytrichloride as triethanolamine complex | 5 g/liter |
| | wetting agent | 0.8 g/liter |
| | pH | >12 |
| | temperature | 25° C |
| | current density | 10 to 30 A/dm$^2$ |
| | deposit formation 1 μ | in 5 seconds |

Since the abrasion resistance of the hard silver coatings is lower than that of the gold platings it is necessary to subject the contacts as far as possible to a uniform silver plating of the zones where the contact is introduced. This can be accomplished by a particularly large nozzle diameter.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for galvanizing limited areas of convex conductive surfaces or surfaces rendered conductive, the said process comprising directing a jet stream of a liquid constituted by an electrolyte solution containing a metal or metal alloy tangentially towards the surface to impinge thereon at the point of tangency or passing the stream in such close proximity to said point of tangency to cause it to be attracted thereto, then permitting the liquid to spread on the curved surface due to the Coanda effect until it is detached at a point spaced from said point of tangency by a suction action whereby a deposit of the metal or metal alloy is formed on the said surface which has its maximum thickness at said point of tangency and has an evenly decreasing thickness toward its outer edges.

2. The process of claim 1 wherein the jet stream emanates from a jet nozzle which forms the cathode and wherein the workpiece on which the said convex surface is formed constitutes the anode of an electrolytic circuit.

3. The process of claim 2 wherein the current profile of the electrolyte is adjusted to obtain a desired thickness distribution of the metal deposit.

4. The process of claim 3 wherein the adjustment of the current profile is effected by varying the shape of the outlet nozzle, the supply of electrolyte, the flow speed of the electrolyte stream, the current density of two or more of these elements.

5. The process of claim 2 wherein the surface areas are galvanized to form electrical contacts.

6. The process of claim 5 wherein the said place of maximum thickness is the place where the electrical contact is expected to undergo its maximum wear.

7. The process of claim 5 wherein two oppositely disposed, closely spaced convex surfaces are simultaneously provided with electrical contacts by passing said jet stream through the space intermediate of the surfaces to make tangential contact with both surfaces.

* * * * *